US005394660A

United States Patent [19]

Haris

[11] Patent Number: 5,394,660

[45] Date of Patent: Mar. 7, 1995

[54] SEGMENTED RETRACTABLE STEEL ROOFS

[76] Inventor: Ali A. K. Haris, P.O. Box 30345, Kansas City, Mo. 64112

[21] Appl. No.: 160,657

[22] Filed: Dec. 2, 1993

[51] Int. Cl.[6] ..... E04B 7/16

[52] U.S. Cl. ..... 52/66; 52/67; 52/6

[58] Field of Search ..... 52/66, 67, 68, 69, 6, 52/72, 83, 64; 49/71

[56] References Cited

U.S. PATENT DOCUMENTS

| | | | |
|---|---|---|---|
| 4,026,076 | 5/1977 | Analetto | 52/6 |
| 4,271,644 | 6/1981 | Rilliet | 52/67 |
| 4,676,033 | 6/1987 | Allen et al. | 52/66 |
| 4,831,792 | 5/1989 | Berger | 52/6 |
| 5,063,730 | 11/1991 | Muramoto et al. | 52/66 |
| 5,117,594 | 6/1992 | Muramoto et al. | 52/66 |
| 5,189,851 | 3/1993 | Omika et al. | 52/66 |
| 5,203,125 | 4/1993 | Sugizaki | 52/66 |

FOREIGN PATENT DOCUMENTS

| | | | |
|---|---|---|---|
| 2413507 | 8/1979 | France | 52/67 |
| 6706913 | 11/1968 | Netherlands | 52/67 |
| 8006712 | 7/1982 | Netherlands | 52/6 |

*Primary Examiner*—Carl D. Friedman
*Assistant Examiner*—Winnie S. Yip

[57] ABSTRACT

A retractable roof system comprised of several inverted U-shaped, inverted L-shaped, and T-shaped segments. The vertical portion of each segment is a truss supporting the roof loads and spanning across the roof opening that can be moved on steel rails in one direction and nest overlapped with each other to produce an opened roof area or moved in the other direction to produce a closed roof.

2 Claims, 5 Drawing Sheets

SEGMENTED RETRACTABLE STEEL ROOFS

BACKGROUND OF THE INVENTION

The present Invention relates to an economical and practical structural system for roofs that can be moved horizontally to be opened or closed. More specific applications of the present Invention are sport facilities such as football and baseball stadiums.

Operable roofs for stadiums allow an adjustable environment for any type of sport event at any time. When the climate is pleasant, the roof can be opened for an outdoor environment for the events. However, if the climate is not suitable for outdoor events, such as rain, snow, or excessive sun or heat, then the roof can be closed to provide an indoor shelter. The operation of the roof movement in this invention is practical and accomplished in a relatively short time to accommodate ongoing events during changes in weather.

Several retractable dome-shaped roofs have been designed and built over stadiums, one of which is the Montreal Olympic Stadium. The system used have been expensive to build or difficult to operate. Other types of designs are used such as "Operable Roof" U.S. Pat. No. 5,203,125, "Movable dome-type roof for structure" U.S. Pat. No. 5,189,851, "Openable roof apparatus" U.S. Pat. No. 5,117,594. The system in the present Invention provides a different design than previous operable roof designs which is more economical and is easier to operate.

SUMMARY OF THE INVENTION

The retractable roof system in the present Invention is comprised of several segments. Each segment is shaped as an inverted L, with the horizontal portion of the segment located at the top to form the partial roof. The vertical leg of the segment is a truss that spans across the field and supports the roof loads. Each segment is staggered vertically and its ends placed at different locations to allow the horizontal roof portions to nest on top of each other and each truss to nest next to the adjacent segment's truss. The free edge of each horizontal segment moves over and is supported by the next segment. The ends of the each segment's truss are supported by a fixed truss or columns and move on a system of rails. The number /f segments depends on the dimensions of the operable portion of the roof. The features and advantages of the present Invention is apparent from the following drawings and detailed description.

DETAILED DESCRIPTION OF THE INVENTION

Figure 1:
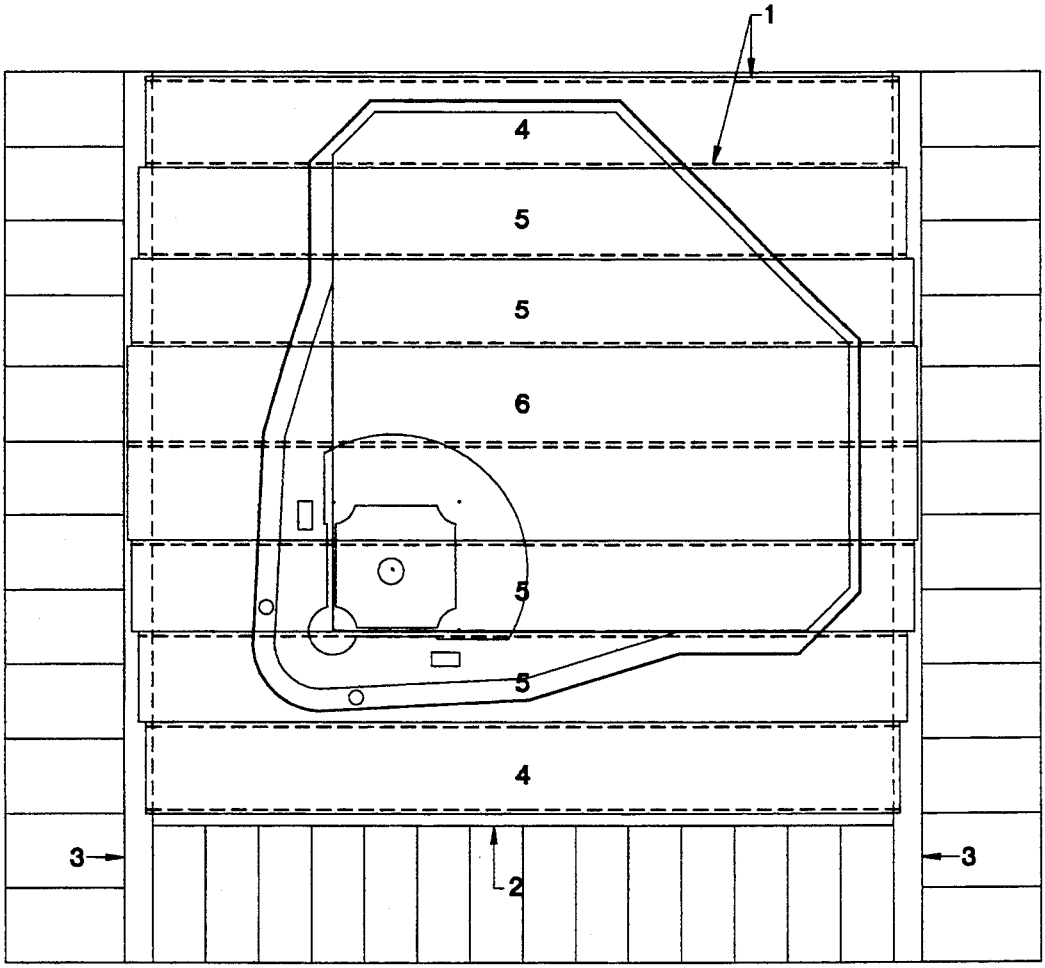
FIG. 1: A plan view of the operable portion of the roof over a baseball stadium when it is closed. The roof shape is rectangular and the roof opens in one direction.
Figure 2:
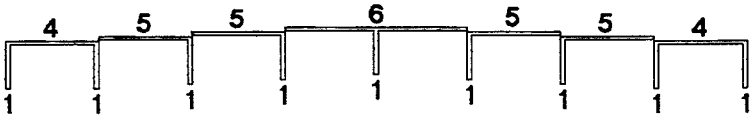
FIG. 2: A cross-section of the roof when closed.
Figure 3:
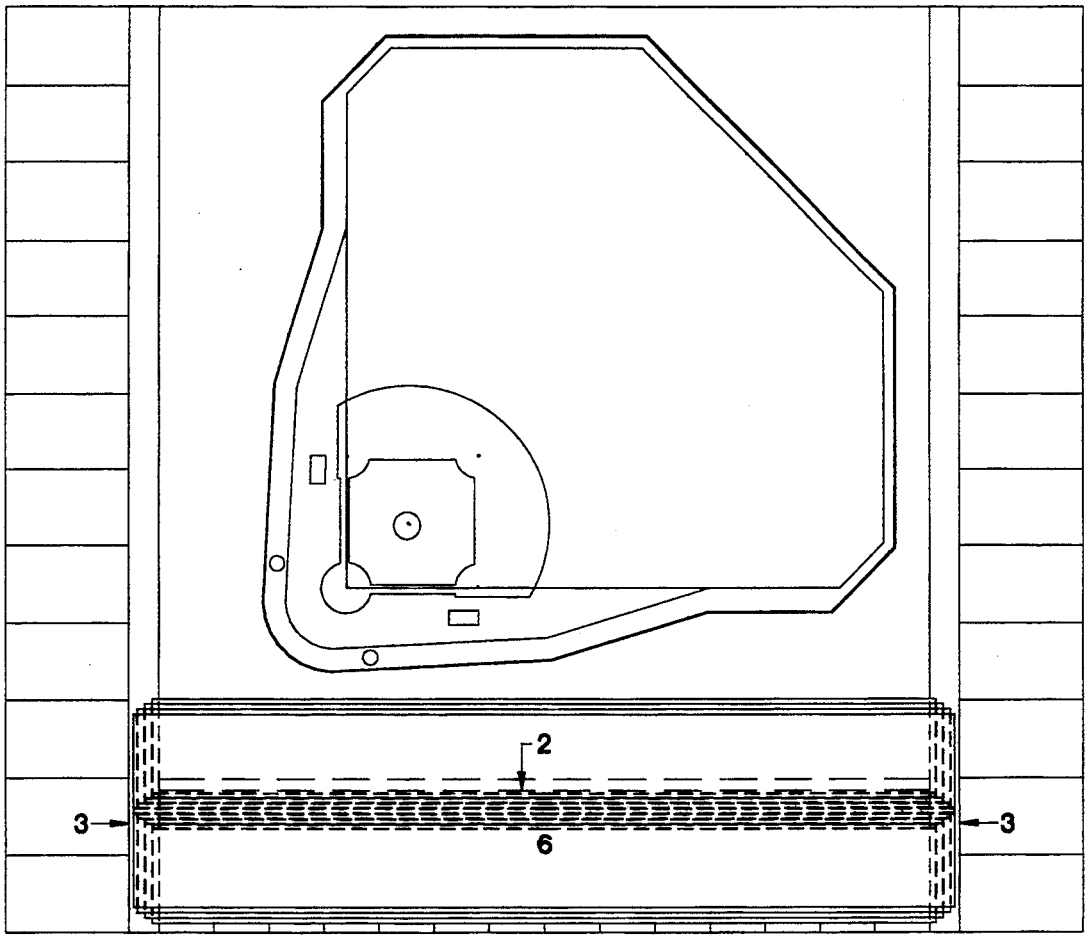
FIG. 3: A plan view of the operable roof framing when it is opened for a rectangular roof shape.
Figure 4:
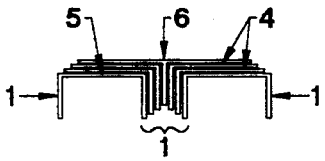
FIG. 4: A cross-section of the roof when open.

The operable roof is comprised of several rectangular segments 4, 5, and 6 supported cross over a fixed supporting system 3, as shown in FIG. 1. FIG. 2 is the roof's cross-section when closed. The segments are inverted U shapes for the first and last segments 4, inverted L shapes for intermediate segments 5, and a T shape for the middle segment 6 if the roof retracts to one side of the stadium. Each of the segments is capable of supporting its weight and other roof loads utilizing the steel truss 1 that forms the vertical portion of the segment. FIG. 3 is the roof framing layout for the opened position. FIG. 4 is the cross-section of the roof when the roof is open and the roof segments 4, 5, and 6 are nested within each other.

The first and last segments' cross-section 4 is an inverted U shape that can span between the supports and supports the edge of the horizontal portion of adjacent segment 5. Both vertical portions of the segment 4 are steel trusses 1. The next two segments' cross-section 5 are inverted L shapes, and the middle segment 6 is a T shape. The vertical portions of segments 5 and 6 are trusses 1. For roofs that retract to both sides of the stadium, two inverted L-shaped segments 4 are used in the middle instead of a T segment 6 in the middle.

Figure 5:
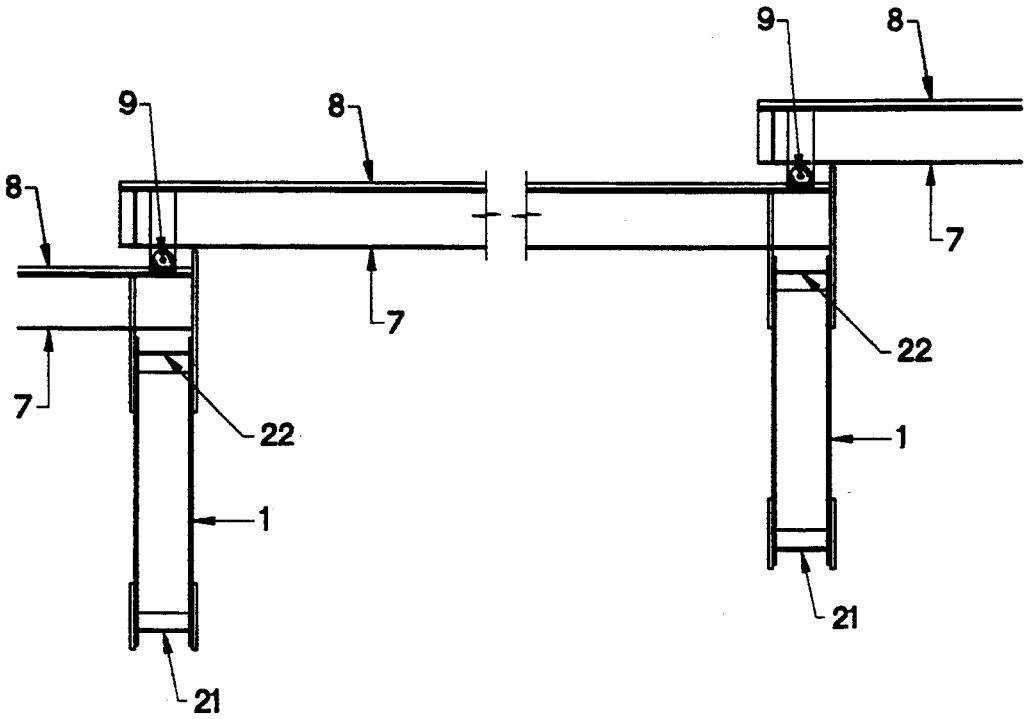
FIG. 5: Detailed cross-section through the roof segments.
Figure 6:
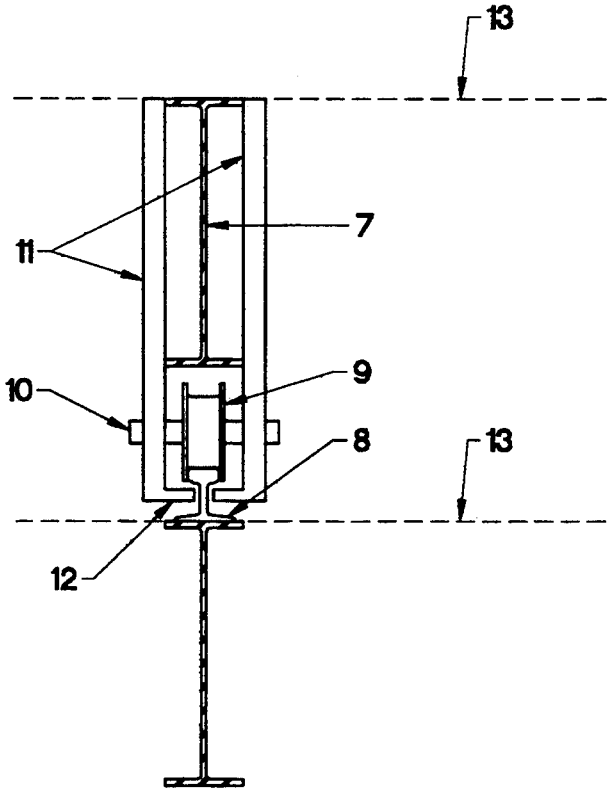
FIG. 6: Detail section at the rails. The roof cladding is shown as fabric. Other types of cladding, such as metal decks, may be used.

FIG. 5 is a detailed section of the segment 5. The first and last segments 4 are similar except that they are comprised of two trusses 1 supporting both edges of the horizontal portion as well as the adjacent segment 4, as shown in FIG. 2. The middle segment 6 is also similar to the segment in FIG. 5 except that the horizontal framing extends on both sides of the truss 1. The horizontal portion of each segment 5 and the middle T segment 6 is comprised of a plurality of steel wide-flange sections 7 each supported at one end by the truss 1 and at the other end by the adjacent lower segment utilizing a sliding detail. The sliding detail shown in FIG. 6 consists of steel wheel 9 and axle 10 attached to side plates 11 that are welded to the steel beam 7. The steel wheel 9 rotates around the axle 10 that is fixed with welding to the plates 11. The steel wheel rests, and moves, on a rail 8 that is connected to the steel framing of the adjacent lower segment. Plates 12 are welded to the side of the axle attachment plates 11 forming ledges on each side of the rail web just below the rail flange to provide resistance to uplift due to wind. The roof cladding 13 can be fabric or metal deck or other desired material.

Figure 7:
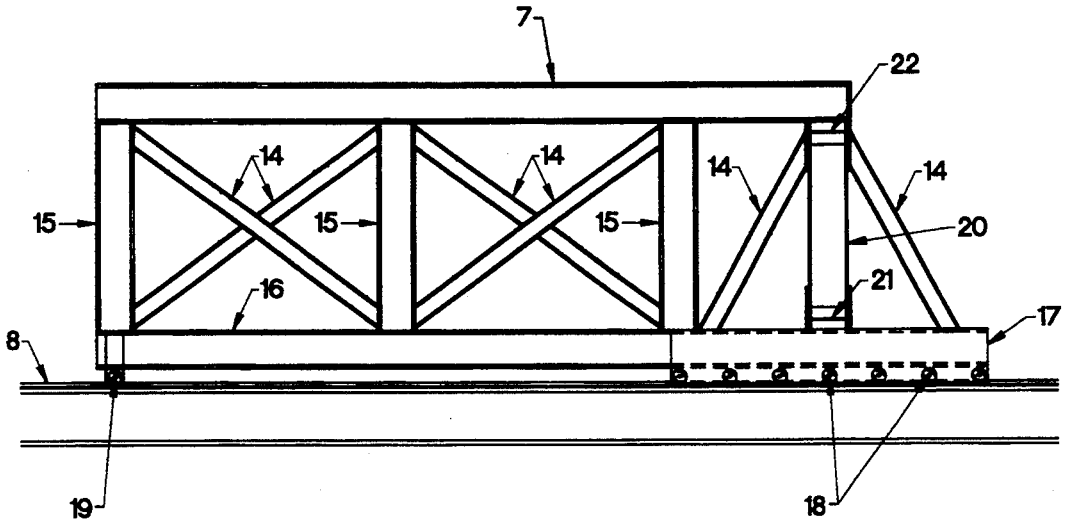
FIG. 7: Detailed elevation section at the end of the segments /ver the supports.

Horizontal steel bracing members between the beams 7 are used to provide a rigid diaphragm to brace the top chord of truss FIG. 7 is an elevation of a vertical steel brace system at each end of the horizontal portion of the segment. The vertical member 20 of steel truss 1 is supported on a heavy steel beam 16 with steel plates 17 on each side welded to the beam 16. Seven steel wheels and axles 18 are centered with truss 1 axis and connected to the side plates 17. An additional steel wheel and axle 19 is located at the far end of beam 16 from the truss. Wheel 19 stabilizes the segment end and guides the segment during its motion. The steel wheels 18 and 19 move along steel track rail 8. There are four separate track rails 8 at each side of the roof. The first inner tracks are used for the first and last roof segments 4 (see FIG. 1). The second tracks are used for the second and sixth roof segments 5; the third tracks are used for the third and fifth segments 5; and the fourth tracks are used for the middle fourth segment 6. The tracks are connected to a fixed supporting system such as columns or major trusses 25 shown in FIG. 8. The details of the wheel assembly 18 and 19 are the same as those of wheels 9 in FIG. 6. The side plates 17 are similar to side plates 11 in FIG. 6 where ledge plates 12 are located to resist any possible uplift of the roof due to wind.

Figure 8:
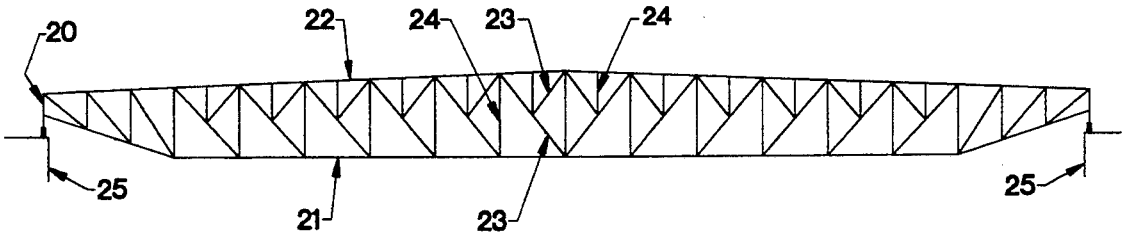
FIG. 8: The segments' steel truss elevation showing top chord sloping toward the ends for roof drainage.
Figure 9:
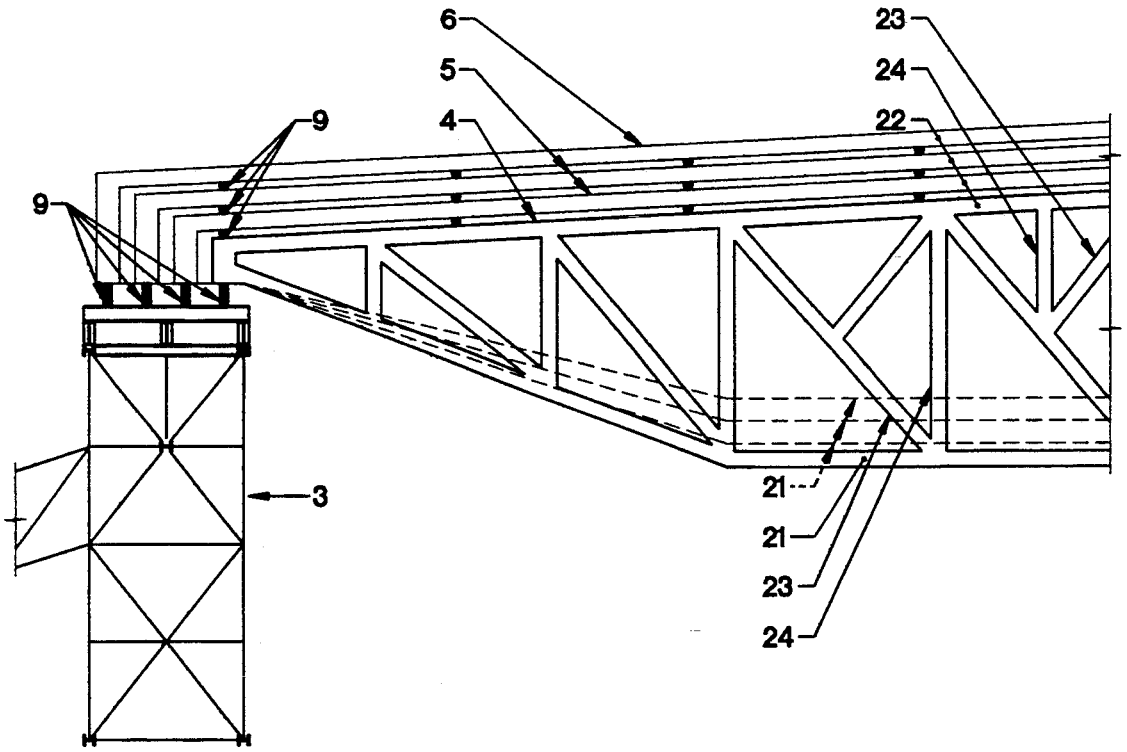
FIG. 9: Detailed elevation section at the end of the segments shows a connection between moving vertical truss and fixed supports.

FIG. 7 shows steel beam 7 at the top and several steel diagonals 14 and vertical members 15 that add lateral stiffness to the ends of the segment and transfer the horizontal force, due to motion, at the base of the wheels to the horizontal portion of the segment at the top of the brace. FIGS. 8 and 9 are elevation of truss 1 consisting of top chords steel members 22 that slope toward the end for drainage, bottom chords steel members 21, diagonal steel members 23, and vertical steel members 24. All steel members' sections are wide flange with the web oriented horizontally, as shown in FIG. 5.

Motors are utilized to operate the roof segments from a closed position to an open position by moving the roof segments toward the roof edge until they are all nested and overlapped with respect to each other, as shown in FIG. 4. The roof is closed by moving the segments apart until they reach their maximum spacing and cover fully the roof area, as shown in FIG. 2.

The foregoing description of the preferred embodiment of the Invention has been presented for the purpose of illustration and description. It is not intended to be exhaustive or to limit the Invention to the precise form disclosed. Many modifications are possible in light of the above teaching. Therefore, the scope of the Invention is not limited by this detailed description, but rather by the claims appended hereto.

I claim:

1. An operable steel roof system for new and existing facilities, comprising a plurality of movable segments supported on two fixed support members, the cross-section of the movable segments are inverted U-shapes for first and last segments, a T shape or two inverted L-shapes for a middle segment, and inverted L shapes for remaining segments between said middle and first and last segments, said each of segments comprising:

a) a vertical portion including a plurality of vertical steel trusses connecting by steel diagonal braces for supporting roof loads of each segment and its adjacent segment, said vertical portion having two ends supported on said two spaced fixed support members, b) a horizontal portion including a plurality of horizontal steel beams connecting by horizontal-bracing members for supporting a roof cladding and providing diaphragm action on said horizontal portion, c) an elongated track (8) secured on each of said horizontal steel beams, d) said horizontal portion having one end supported by said vertical portion and an other end supported by a wheel and axle system which rests and moves along said track over each of said horizontal portion of an adjacent said segment, e) said horizontal portion having a vertical steel brace system connected to each end of said vertical portion, and a plurality of wheels rotatably mounted on a base portion of said two ends of said vertical portion and moving along a steel rail track connected on the each of said fixed support members so that said segments move and nest next to said adjacent segment.

2. Each end of the segments described in claim 1 is placed at a different location from the end of the adjacent segment enabling the segments to move, utilizing motors, toward the adjacent segment until all segments nest in an overlapping position and produce an open roof or to move away from adjacent segments to a fully covered roof.

* * * * *